United States Patent [19]

Fisher et al.

[11] 3,990,501

[45] Nov. 9, 1976

[54] PRESSURE DIE CASTING APPARATUS WITH SPRUE EJECTION MECHANISM

[75] Inventors: William Frederick Fisher; Timothy Brian Hodgson, both of Peterborough, Canada

[73] Assignee: Fisher Gauge Limited, Peterborough, Canada

[22] Filed: Sept. 16, 1975

[21] Appl. No.: 613,811

Related U.S. Application Data

[62] Division of Ser. No. 438,420, Jan. 31, 1974, Pat. No. 3,927,711.

[52] U.S. Cl. ..... 164/347; 92/114; 164/404; 425/444

[51] Int. Cl.[2] ..... B22D 17/22

[58] Field of Search ..... 164/344, 347, 404; 92/114; 425/444

[56] References Cited

UNITED STATES PATENTS

| | | | |
|---|---|---|---|
| 2,624,659 | 1/1953 | Haug et al. | 92/114 X |
| 3,844,335 | 10/1974 | Scott et al. | 164/344 X |

*Primary Examiner*—Robert D. Baldwin

[57] ABSTRACT

In a pressure die casting apparatus, a die locking device in which a locking member is pivotably mounted on a frame and is movable into a position opposing a die part mount to have the force on the die part in the casting operation act through the locking member onto the frame substantially in the direction of that force. Another die locking device employs a main cylinder and piston assembly and an auxiliary cylinder and piston assembly with the chambers of the two cylinders interconnected whereby actuation of the auxiliary piston locks pressurized fluid in the main chamber. A sprue ejector mechanism has a plunger movable in a tubular piston rod, the end of the plunger being threaded to a collar and held to the piston rod and a cap threaded to the end of the piston rod, all for precise adjustment of the plunger in the die cavity. In the sprue ejector mechanism a fixed piston and a forwardly located free piston are mounted on the piston rod to advance the plunger suddenly into the gate of the die and then to retract the plunger from the die cavity. A mount for holding a die part comprises a pair of side channels cooperating with a central block to form a C-shaped bracket, at least one of the brackets being slidable by a rack and piston assembly to give lateral access of the die part to the mount.

6 Claims, 11 Drawing Figures

PRESSURE DIE CASTING APPARATUS WITH SPRUE EJECTION MECHANISM

This is a divisional of application Ser. No. 438,420 filed Jan. 31, 1974, now U.S. Pat. No. 3,927,711 issued Dec. 23, 1975.

This invention relates to pressure die casting.

A problem in pressure die casting is the force required to ensure that the die is properly closed against the high internal pressure of the injected metal. Devices presently in use employ a heavy hydraulic cylinder or a toggle mechanism assembly to close and to lock the movable die parts. An improved device using pivotal leverage, and employing a force acting in the direction of closing movement of the die, is disclosed in U.S. Pat. No. 3,701,377 issued Oct. 31, 1972 to Fisher Gauge Limited assignee of William F. Fisher. Such devices are not practical to overcome flashing at very high pressures, in the order of 4000 to 5000 pounds per square inch, and flashing on each casting must be trimmed by an additional trim press before it is tumbled and tapped.

It is an object of the present invention to provide an improved apparatus for releasably locking a die part in a high pressure die casting operation, using pivotably mounted means acting substantially in the direction of closing movement of the die part.

It is another object of the invention to provide an improved apparatus, for closing and releasably locking a die part in a high pressure die casting operation, in which a piston in main cylinder and piston assembly is locked by an auxiliary cylinder and piston assembly.

Another object of the invention is to provide a sprue ejector mechanism which is finely adjustable and has a plunger rod which is easily removable, and to provide an efficient cylinder and piston assembly for advancing and retracting the sprue ejector.

A further object of the invention is to provide an improved mount for holding a die part, in which the die part may be inserted laterally into the mount, preferably from either of two opposed directions.

An example embodiment of the invention is shown in the accompanying drawings in which.

Figure 1:
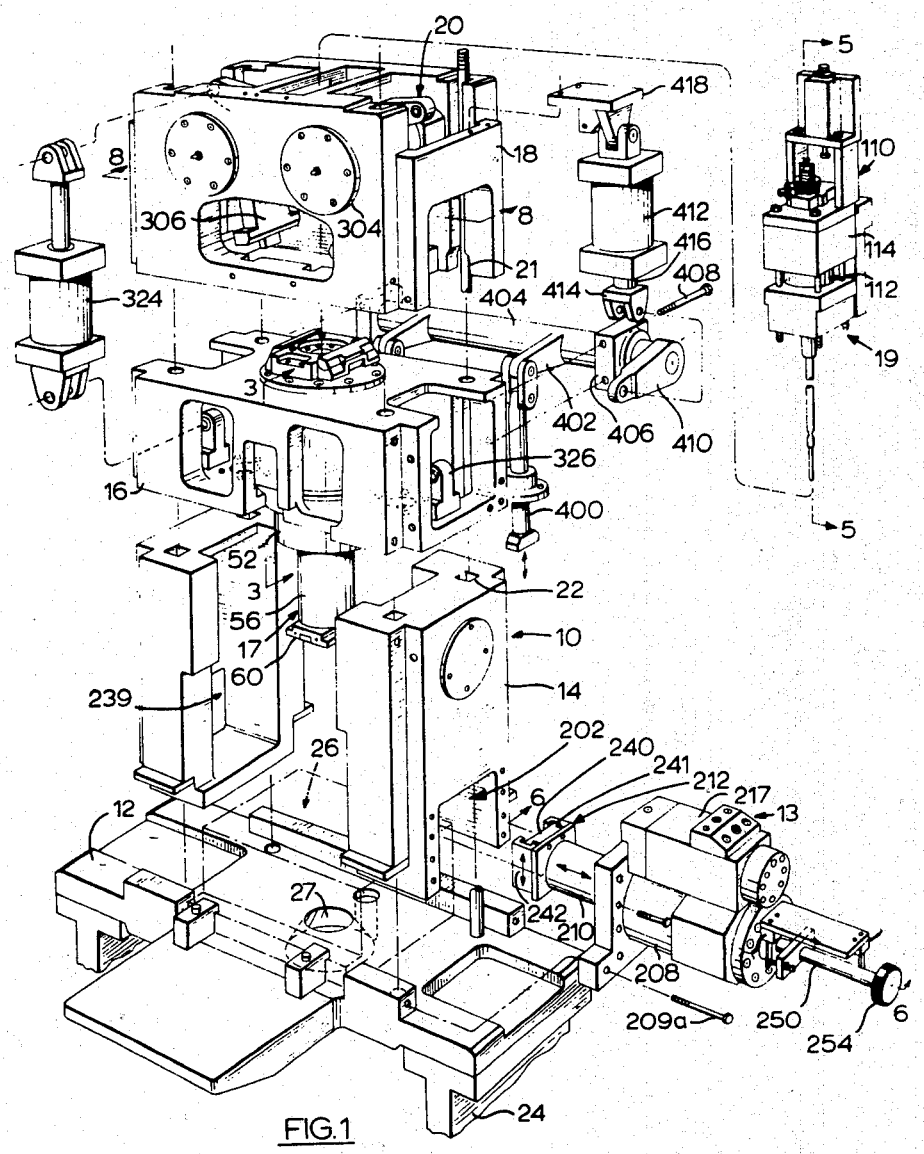
FIG. 1 is an exploded perspective view of an injection die molding apparatus according to the invention.
Figures 5, 5A:
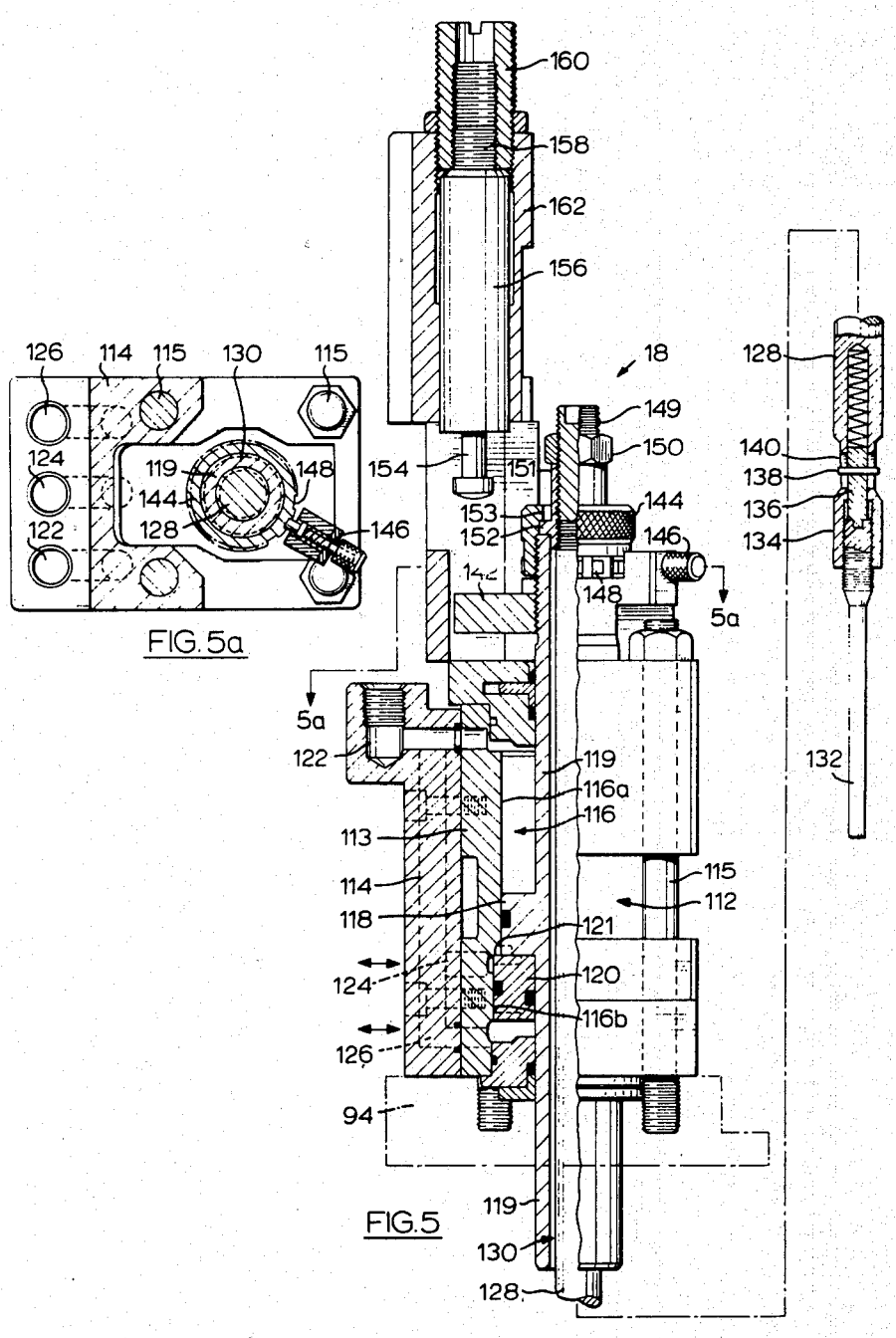
FIG. 5 is a view of a core ejection mechanism taken along line 5—5 of FIG. 1, partly in cross-section.
Figures 6, 7:
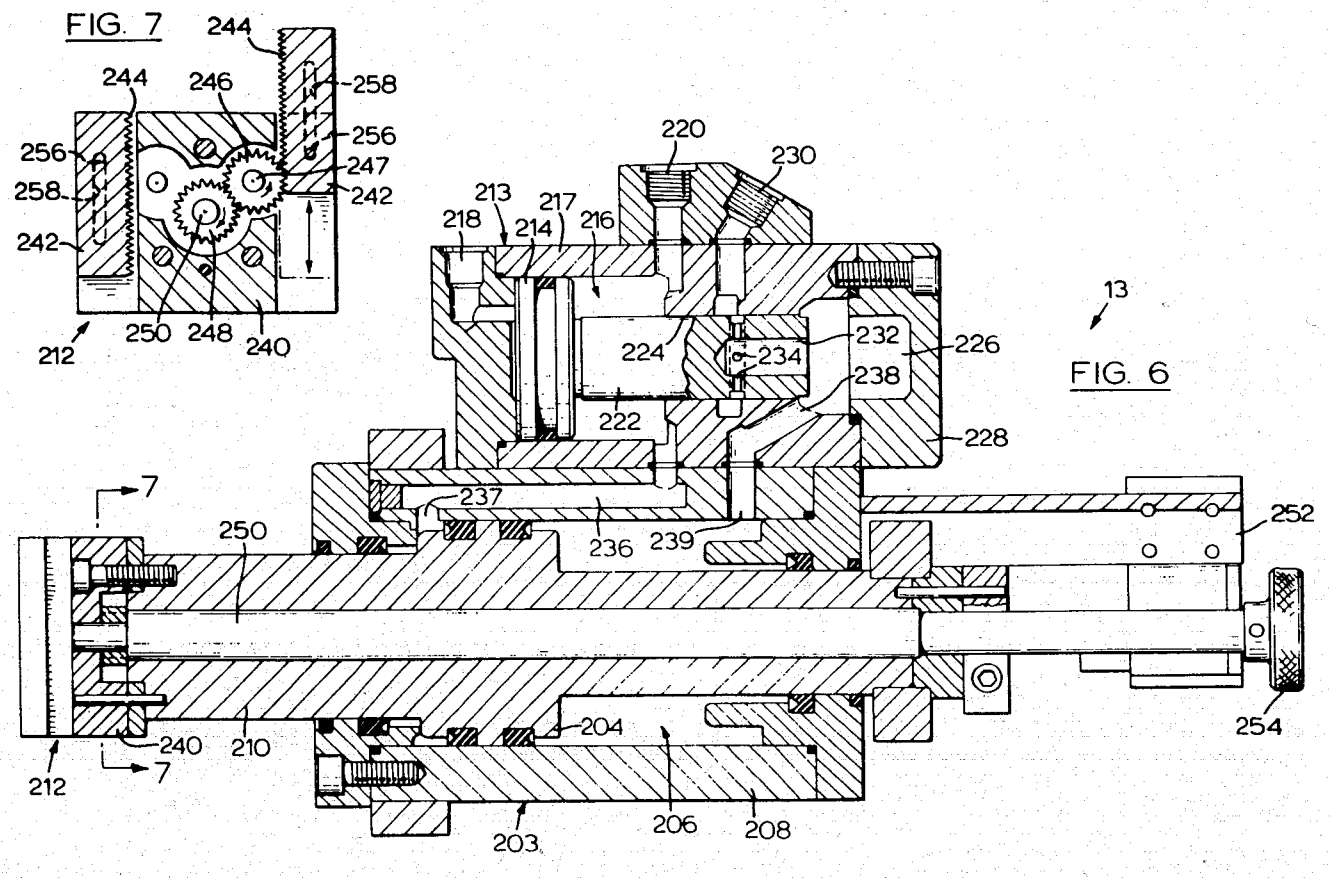
Figure 8:
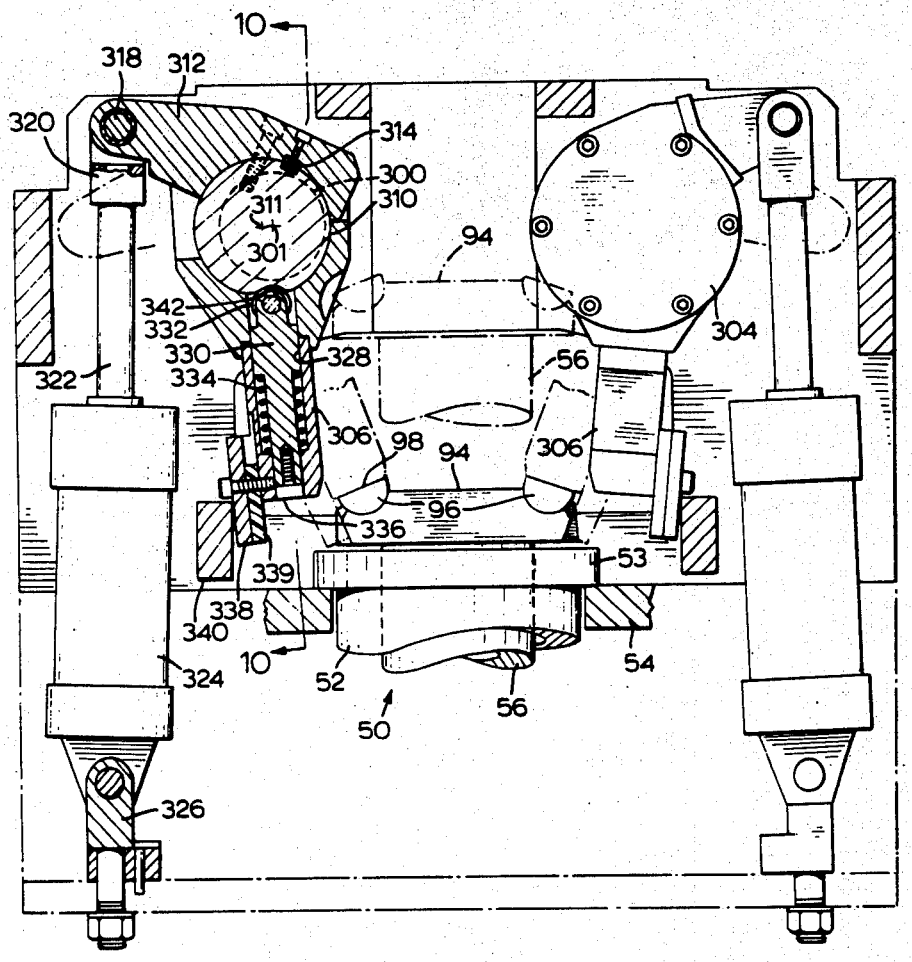
Figure 9:
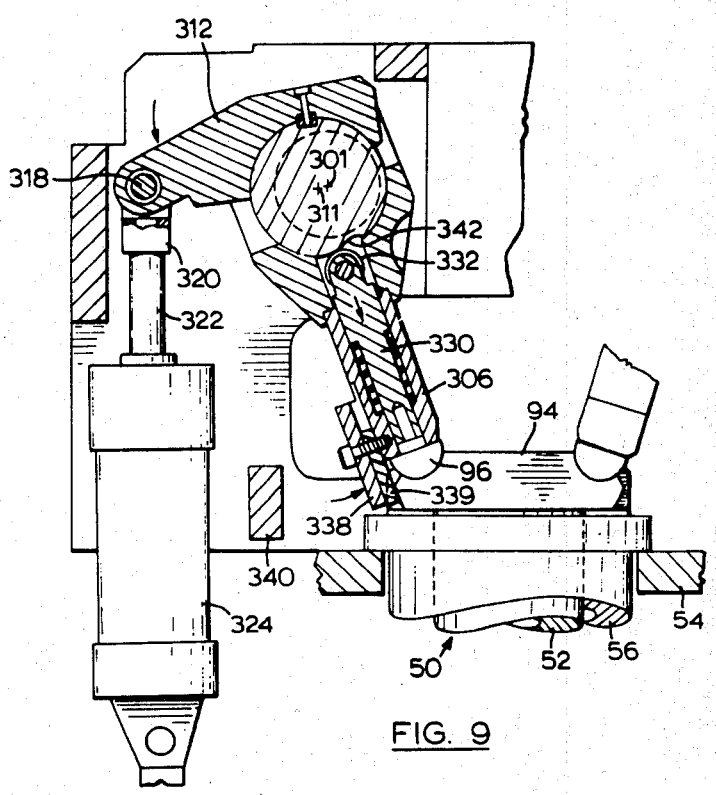
Figure 10:
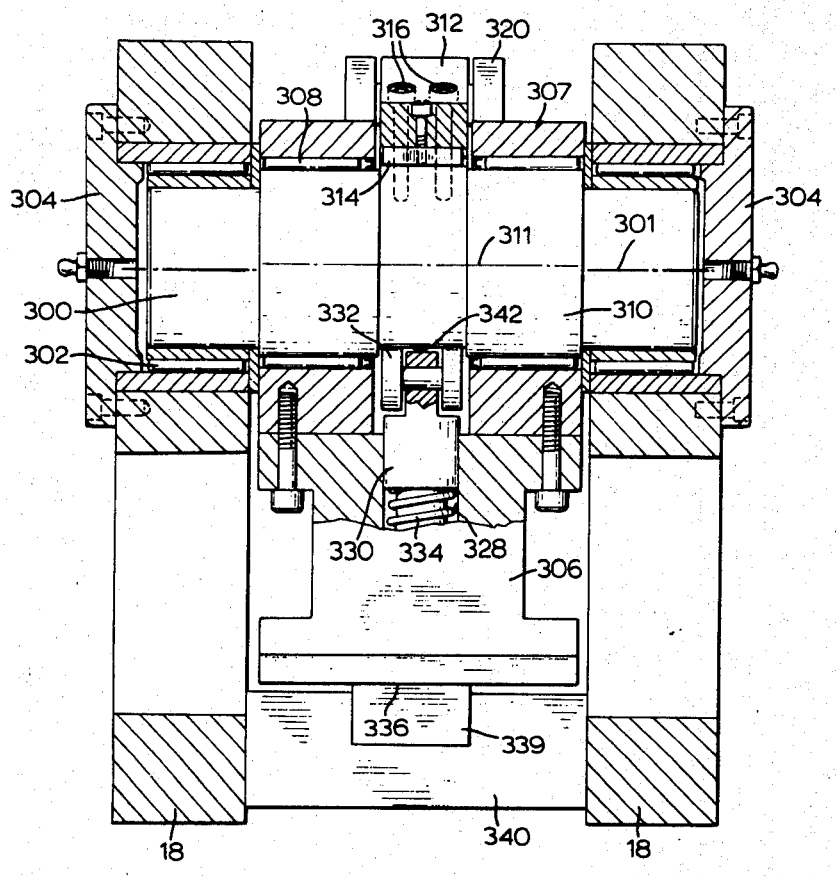

FIG. 5*a* is a view taken along line 5*a*—5*a* of FIG. 5;

FIG. 6 is a view of a horizontal die closing unit in cross-section taken along line 6—6 of FIG. 1;

FIG. 7 is a cross-sectional view taken along line 7—7 of FIG. 6;

FIG. 8 is a view of a locking device taken along line 8—8 of FIG. 1;

FIG. 9 is a view similar to FIG. 8 showing the locking device in operation;

FIG. 10 is a cross-sectional view taken along line 10—10 of FIG. 9;

The embodiment shown in the drawings comprises a frame 10 which is sectioned for convenience of construction into a platform 12 carrying a horizontal die closing unit 13, a pair of vertical columns 14, a first crosshead 16 carrying a vertical die closing unit 17, and a second crosshead 18 carrying a locking unit 20, all held together by a plurality of bolts 21 passing through aligned vertical passages 22 in each of these vertically stacked members. Frame 10 rides on a yoke 24 which is movable to seat and unseat a gate 25 of a die 26 (see FIG. 2). Die 26 is held by frame 10 on an injection nozzle (not shown) which projects through an aperture 27 in platform 12 (see FIG. 1), as described in abovemetioned United States Patent No. 3,701,377.

Figure 2:
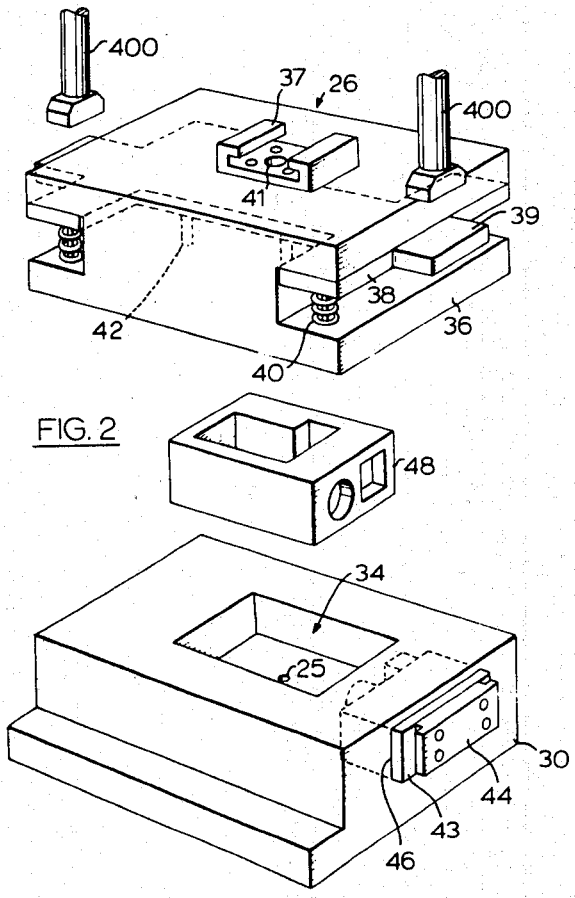
FIG. 2 is an exploded perspective view of a die for use with the apparatus of FIG. 1.

A simplified example die 26, for use with the apparatus of the invention, is shown in FIG. 2 of the drawings and comprises a lower die part 30 having a well 34, and an upper die part 36 which closes well 34 and carries a C-shaped die mount channel 37 and has a centrally located aperture 41. Upper die part 36 also carries an ejector plate 38 with wings 39, the ejector plate being biased upwardly by compression springs 40 and having a plurality of ejection pins 42 which lie in upper die part 36. Lower die part 30 has a lateral block 43 which carries a T-shaped die mount flange 44 and fits into an aperture 46 in the side of the die part. A sample die product 48 is also shown in the exploded diagram of FIG. 2.

Figure 3:
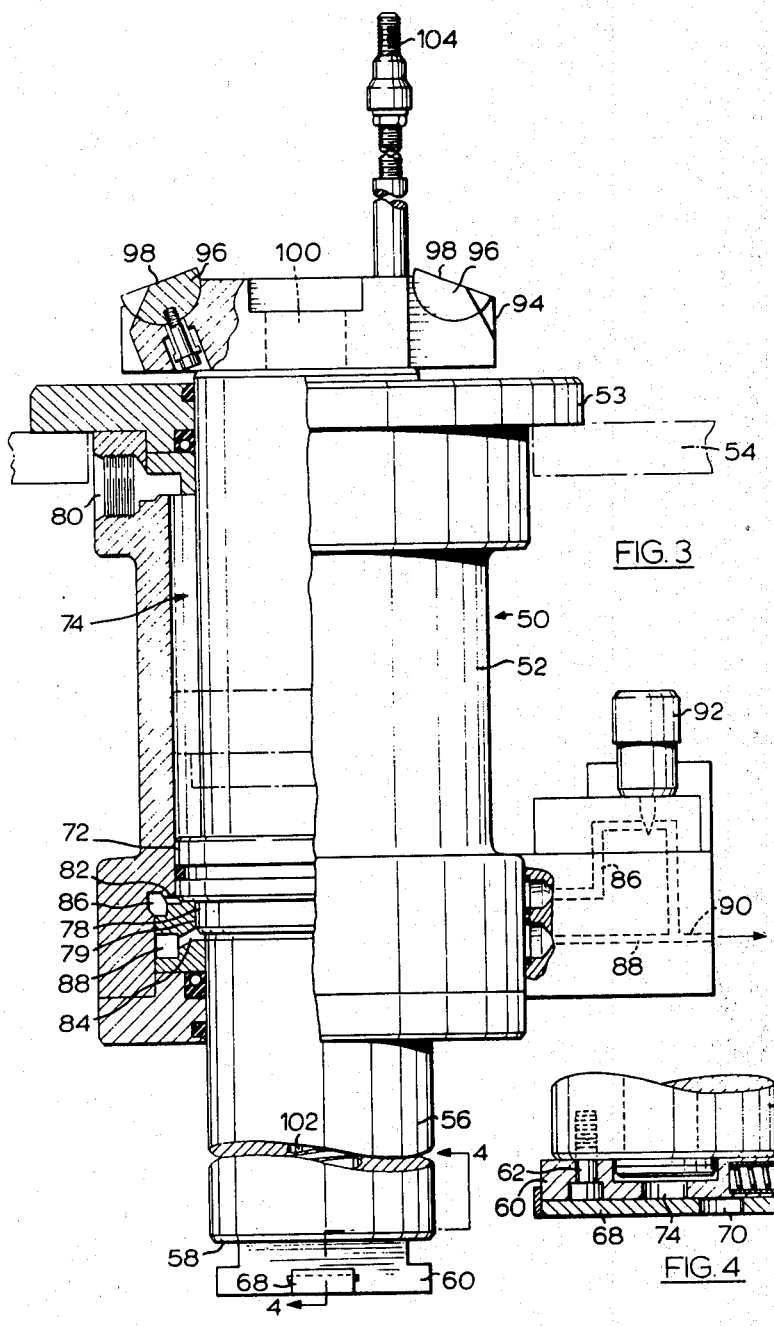
FIG. 3 is a view of a vertical die closing unit taken along line 3—3 of FIG. 1, partly in cross-section.
Figure 4:
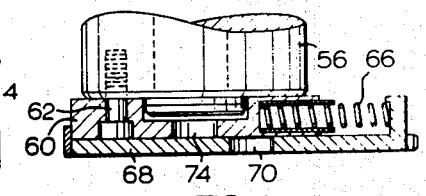
FIG. 4 is a view taken along line 4—4 of FIG. 3.

Vertical die closing unit 17, carried by first crosshead 16 and shown in FIGS. 3 and 4 of the drawings, comprises an hydraulic cylinder and piston assembly 50 with a cylinder 52 fixed by an end plate 53 to a bridge plate 54 of the crosshead and a piston rod 56 extending in both directions from the cylinder, as seen more particularly in FIG. 3 of the drawings. Lower end 58 of piston rod 56 carried a flange 60 which is fixed to the piston rod by a bolt 62 and is receivable in die mount 37 of upper die part 36 (see FIG. 2). As seen in FIG. 4, a central aperture 64 in flange 60 is held closed by a compression spring 66 acting on a slide 68 which has an offset aperture 70.

An annular piston 72 fixed on piston rod 56 moves vertically in a closed chamber 74 of cylinder 52 and the piston is stepped to provide a shoulder 78 of reduced diameter which is receivable in a cylinder recess 79 in the lower end of the chamber. A first port 80 opens into the upper end of chamber 74, a second port 82 opens into the lower end of the chamber, and a third port 84, larger than port 82, opens into recess 79. ports 82 and 84 connect with passages 86 and 88 respectively in cylinder 52 which lead in parallel to a common outlet 90. A check valve 92, located in passage 86, controls the outflow of fluid from port 82.

A locking plate 94 is fixed on the upper end of piston rod 56 carries a pair of parallel bearing pads 96 having upwardly directed and outwardly diverging flat faces 98. Locking plate 94 has a central aperture 100 which is aligned with an axial bore 102 in piston rod 56 which is in turn aligned with aperture 64 in flange 60. Locking plate 94 also carries an upwardly projecting limit switch actuator 104.

A sprue ejection mechanism 110 carried by locking plate 94, is shown in detail in FIGS. 5 and 5*a* of the drawings. Mechanism 110 has a vertical hydraulic cylinder and piston assembly 112 which is fixed in a mount 114 attached to locking plate 94 by bolts 115. In assembly 112 a cylinder 113 has a closed chamber 116 in which a first piston 118 reciprocates. Piston 118 is annular and is integral with a piston rod 119. A second, annular free piston 120, larger than first piston 118, also reciprocates in chamber 116 on piston rod 119 between piston 118 and the bottom of the chamber.

Chamber 116 comprises an upper bore 116*a* accommodating first piston 118 and a lower, larger, bore 116*b* accommodating free pisto 120 which is limited in its upper travel by a shoulder 121 formed between bores 116a and 116*b*. A first port 122 opens into the upper end of upper bore 116*a* of chamber 116, a second, annular port 124 opens into the upper end of lower bore 116*b* of chamber 116, and a third, annular port 126 opens into the lower end of lower bore 116*b* of chamber 116.

A plunger rod 128 passes through an axial bore 130 in piston rod 119 and the rod carries at its lower end a plunder 132 which is threaded into a socket 134 in the rod. Plunger 132 is held against rotation by a spring loaded key 136 movable by a bar 138 projecting through an aperture 140 in plunger rod 128. The upper end of piston 119 projects from cylinder 113 and the rod is externally threaded to receive both a laterally projecting bar 142 and crenellated cap 144 which is internally threaded. A spring loaded locking pin 146, mounted on bar 142, is urged into engagement with crenellations 148 circumferentially located on cap 144. Plunger rod 128 projects upwardly through cap 144 and is threaded at its upper end 149 to carry a locking nut 150 and a collar 151 which is threaded internally to engage the upper end of the plunger rod and carries externally an annular shoulder 152 resting on the end of piston rod 119 and a key (not shown) which is received in a transverse slot in the end of rod 119. Cap 144 has a central aperture 153 enabling the cap to pass nut 150. Bar 142 projects laterally from piston 119 below a vertical damping plunger 154 which projects downwardly from an hydraulic cylinder 156 having a threaded upper post 158. An internally and externally threaded tube 160 engages post 158 and is engaged by an extension 162 of mount 114.

Horizontal die closing unit 13, shown in FIGS. 6 and 7, is mounted on platform 12 and projects laterally through an archway 202 in column 14. Unit 13 includes a main hydraulic cylinder and piston assembly 203 having an annular piston 204 reciprocable in a closed chamber 206 of a cylinder 208 which is fixed on a mounting plate 209 attached by bolts 209a to platform 12 and column 14. A piston rod 210, on which piston 203 is fixed, extends from each end of cylinder 208 and carries at its forward end a C-shaped mounting bracket 212 which is engagable with T-shaped flange 44 on die part 30 of die 26 (see FIG. 2). A cylinder and piston assembly 213 has a piston 214 which reciprocates in a closed chamber 216 of a cylinder 217 having a first port 218 in the forward end of chamber 216 and a second port 220 in the rearward end of chamber 216. A piston rod 222 extends rearwardly from piston 214 through a bore 224 in cylinder 217 and projects into a surge chamber 226 in a housing 228, to act as a further piston. A third port 230 leads into bore 224 and an axial passage 232 with radial passages 234 connects port 230 with surge chamber 226 when auxiliary piston 214 is at the forward end of chamber 216. A passage 236 connects auxiliary chamber 216 of cylinder 217 with a port 237 opening into main chamber 206 forwardly of piston 204 while another passage 238 connects further chamber 226 with a port 239 opening into main chamber 206 rearwardly of piston 204.

A second horizontal locking unit 13 may be mounted to project through an archway 239 in the vertical column 14 opposite archway 202.

As seen in FIGS. 6 and 7, bracket 212 on piston rod 210 comprises a T-shaped central block 240 (see FIG. 1) and a pair of sliding side channels 242 each having a rack 244 along one side edge engagable with an idler gear 246 which is removably mounted on either of a pair of pins 247 on block 240. Gear 246 meshes with a drive gear 248. Idler gear 246 is shown in FIG. 7 engaging one of channels 242, the other channel being suitably locked to block 240 as by a pin. Drive gear 248 is keyed on a shaft 250 which is coaxially mounted in piston rod 208 for free axial rotation. The end of shaft 250 remote from drive gear 248 is supported on a frame 252 and carries a knurled knob 254. Each channel 242 is kept from dropping out of bracket 212 by a pin 256 fixed in central block 240 and projecting into a slot 258 in the side of channel facing the block.

Locking unit 20 is carried by second crosshead 18 as shown in FIGS. 8, 9 and 10 of the drawings. A pair of parallel, horizontal bearing shafts 300 having axes 301 are journally mounted on needle bearings 302 in the second crosshead and the bearings are protected by end caps 304, as seen in FIG. 10. Each shaft 300 has a central eccentric portion 310 with an axis 311 offset from axis 301 of the shaft and parallel to that axis, as seen in FIG. 8. A locking arm 306 depends from each shaft 300 and is journally mounted on eccentric portion 310 by a collar 307 and needle bearings 308, the locking arm being radial to the collar. One end of a crank arm 312 is fixed to eccentric portion 310 by a key 314 and further secured to the eccentric portion by bolts 316. The other end of crank arm 312 is pivotally connected by a pin 318 to the forked free end 320 of a piston rod 322 of a hydraulic jack 324 which is pivotably mounted on a block 326 fixed on first crosshead 16. Each locking arm 306 has an internal bore 328 which houses a plunger 330 carrying a freely rotating follower 332 at one end. A compression spring 334 urges follower 332 against eccentric 310 and maintains the lower end of plunger 330 inside bore 328. Each locking arm 306 terminates in a flat bearing face 336 and carries stop means in the form of a lateral flange or plate 338 movable laterally towards a cross bar 340 of second crosshead 18. Plate 338 in turn carries a stop bar 339, preferably of TEFLON (a trade mark) which is engagable with the side of locking plate 94 on lateral movement of plate 338 in the other direction. Eccentric 310 has a circumferentially oriented cam recess 342 which receives follower 332 when piston rod 322 of jack 324 is extended as seen in FIG. 8. Thus follower 332 yieldably couples collar 307 to shaft 300 for common rotation with that shaft as long as locking arm 306 is movable laterally.

As seen in FIGS. 1 and 2, ejector plate 38 of die 26 is actuated by a pair of legs 400 pivotally suspended from a pair of radial arms 402 fixed on a shaft 404 which is journally mounted in bearing blocks 406 fixed laterally to crosshead 16 by bolts 408. One end of shaft 404 carries a crank arm 410 which is pivotably connected to an hydraulic jack 412 by a yoke 414 on the free end of a piston rod 416 of the hydraulic jack. Jack 412 is pivotably suspended from a bracket 418 mounted on crosshead 18.

In the operation of the example embodiment, upper die part 36 is attached by die mount 37 to flange 60 on piston rod 56 of vertical die closing unit 17. As seen in FIG. 3, to close die 26, piston 72 is moved downwardly in chamber 74 of cylinder 50 by introducing hydraulic fluid under pressure into first port 80 and allowing hydraulic fluid to escape from second and third ports 82 and 84. Because port 84 is large, more fluid will escape through that port until shoulder 78 enters recess 79 as piston 72 approaches the lower end of chamber 74. This cuts off larger port 84 from the remainder of the fluid above the shoulder which must then pass out through smaller port 82, providing a cushioning effect which may be regulated by check valve 92. This cushioning protects the die.

When upper die part 36 has been closed on lower die part 30 as described above, vertical die closing unit 17 is locked in position by locking unit 20 which is shown more particularly in FIGS. 8, 9 and 10. As seen in FIG. 8, cylinder and piston assembly 50 rests on bridge plate 54 with locking plate 94 fixed on piston rod 56. Locking arms 306, when at rest, are each displaced laterally from locking plate 94 by extending piston rod 322 of jack 324 until plate 338 is moved to a position adjacent crossbar 340, thus giving clearance for locking plate 94 to be raised by piston rod 56 as shown in broken lines in FIG. 8. To lock piston rod 56 in its lowered position, jacks 324 are actuated to retract piston rods 322, which causes shaft 300 and collar 307, interlocked by follower 332, to rotate together and thereby to swing laterally over locking plate 94, locating bearing faces 336 above faces 98 of bearing pads 96. The lateral inward swing of each locking arm 306 is arrested by stop bar 339 coming into contact with locking plate 94, thereby arresting the rotation of collar 307 in conjunction with shaft 300. However, shaft 300 continues to rotate whereupon follower 332 moves out of recess 342 against the action of spring 334. This continued rotation of shaft 300 causes axis 311 of eccentric 310 to swing about axil 301 in the direction of pad 98, as seen in FIG. 9, which moves collar 307 and locking arm 306 towards bearing pad 98. This is essentially a lever of the third order where the load is between the fulcrum and the applied force. Preferably lever arm 312 swings in an arc of about 45°; in the first 15° locking arm 306 is swung laterally to face bearing pad 98, in the second 15° locking arm 306 is moved longitudinally to take up the clearance between bearing face 336 and bearing pad 98, and in the third 15° other variables such as die thickness are taken up. The release of locking plate 94 is effected by extending piston rods 322 from jacks 324 to rotate shaft 300, causing follower 332 to seat again in recess 342 of eccentric 310 by the pressure of spring 334. This releases the locking force on bearing pad 96 and locking arm 306 thereupon swings laterally away from locking plate 94 by the continued rotation of shaft 300. It will be appreciated that the lever action of axis 311 swinging about axis 301 and the use of anti-friction bearings 308 prevents the mechanism from seizing as it would do if only the eccentric itself were to be used.

To close aperture 46 in lower die part 30, block 43 is attached by flange 44 to bracket 212 on horizontal die closing unit 13. As seen in FIG. 7, the manual operation of knob 254 rotates gears 246 and 248 which raises one channel 242, allowing bottom die part 30 of die 26 to slide laterally onto platform 12 for engagement of flange 44 by bracket 212. When flange 44 is in place, channel 242 is lowered again. Block 43 is then ready to be moved by piston 204 into aperture 46 of lower die part 30. To actuate piston 204, hydraulic fluid under pressure is introduced into third port 230 and, with auxiliary piston 214 advanced against first port 218 as seen in FIG. 6, the fluid passes through radial passages 234, passage 232, chamber 226, passage 238 and port 239 into chamber 206. As piston rod 210 is extended forwardly (to the left in the drawing), hydraulic fluid on the other side of piston 204 escapes from chamber 206 through port 237 and passage 236 into auxiliary chamber 216 and out through second port 220. When piston rod 210 has been fully extended forwardly (as seen in FIG. 6), hydraulic fluid under pressure is introduced into auxiliary chamber 216 through first port 218 to move auxiliary piston 214 rearwardly to move radial passages 234 out of registration with third port 230, locking piston rod 210 in its fully extended position. Thus assembly 213 acts as an intensifier of locking pressure, the fluid pressure in surge chamber 226 and chamber 206 of cylinder 208 being increased by the ratio between the diameters of piston 214 and piston rod 222. To retract piston rod 210 rearwardly (to the right in the drawing), hydraulic fluid under pressure is introduced through second port 220 into the auxiliary chamber 216 which moves auxiliary piston 214 towards first port 218 and opens chamber 226 to third port 230 through radial passages 234, allowing the pressurized hydraulic fluid in chamber 206 of cylinder 208 to escape. Theyhydraulic fluid under pressure introduced through second port 220 also passes through passage 236 into chamber 206 to move piston 204 and retract piston rod 210. It will be appreciated that the operation of horizontal die closing unit 13 is controlled by suitable micro-switches not shown, as in the other operable units of the example embodiment.

When die 26 has been closed, plunger 132 is advanced into the die cavity through aperture 41 in upper die part 37. Referring to FIG. 5, this is achieved by introducing hydraulic fluid under pressure through port 122 into chamber 116 of cylinder 113 and releasing the fluid pressure at ports 124 and 126, thus moving piston 118 downwardly to meet free piston 120 which rests against the lower end of chamber 116.

In this position of piston 118, plunger 132 projects into gate 25 of die 26 to clear the gate of any sprue remaining from a previous casting. Plunger 132 is then withdrawn from gate 25 by introducing fluid under pressure through port 126 into chamber 116. Because the area of free piston 120 is greater than the area of piston 118, the fluid pressure introduced through port 126 will cause piston 120 to rise until it bears against shoulder 121 between bores **116*a* and 116*b* of chamber 116. A vertical adjustment of plunger 132 may then be made to provide a correct gap for inflow of metal through gate 25 of die 26 and this vertical adjustment is effected by rotating rod 128. Threaded upper end portion 149 of rod 128 engages collar 151 which cannot rotate because it is keyed to the end of piston rod 119**.

Plunger 132 is now in position for the casting operation to begin by advancing die 26 onto the injection nozzle. After injection and solidification, die 26 is withdrawn from the casting nozzle as described in aforementioned U.S. Pat. No. 3,701,377. When die 26 is clear of the injection nozzle, fluid pressure is released from port 126 and plunger 132 is moved down once again to clear gate 25 of any sprue material. Next fluid pressure is applied to port 124 and released from port 122 to retract the punch from the casting in die 26. When bar 142 strikes damping plunger 154 the abrupt upward movement of plunger 132 is arrested. All the above functions are precisely timed by a suitable electronic sequence circuit, in fractions of seconds. It will be noted that plunger 132 does not advance initially until die 26 is closed, to prevent damage to the plunger in the event that a casting has fallen onto lower die part 30.

Plunger 132, when inserted through aperture 64 of flange 60 and through aperture 70 of slide 68, acts against compression spring 66. If plunger 132 does not project into die aperture 49 the aperture is sealed by slide 68 to prevent molten metal from being released under pressure through the aperture. The structure of sprue ejection mechanism 110 makes plunger 132 readily replacable.

To open die 26, locking arms 306 of vertical die closing unit 17 are released from bearing pads 96 and swung laterally as described above, whereupon piston 56 in cylinder 22 is raised. If the cast product is carried upwardly by upper die part 36 as piston 56 is raised, the product is released by actuating jack 412 (see FIG. 1) to extend piston rod 416 downwardly, causing legs 400 to bear against wings 39 of ejector plate 38 and forcing the ejector plate downwardly against the action of springs 40 (see FIG. 2).

To sum up the steps employing the example embodiment to make a casting, vertical die closing unit 17 is raised and horizontal die closing unit 13 is retracted. Lower die part 30 is placed on platform 12 to have gate 25 register with aperture 27. Upper die part 36 is then attached by die mount 37 to flange 60 of vertical die closing unit 17 and block 43 is attached by die mount 44 to channel 212 of horizontal die closing unit 13. Actuation of units 13 and 17 cause die 26 to be closed. Plunger 132 is adjusted, to have its lower end terminate in gate 25 of die 26 when pistons 118 and 120 are in their lowermost positions in chamber 116 of cylinder 114; this is done by rotating plunger rod 128 in collar 151 and then turning locking nut 150 against the collar. The plunger is then retracted out of the gate by introducing fluid under pressure through ports 122 and 126 into chamber 116 of cylinder 114. Being of larger diameter, free piston 120 forces piston 118 upwardly until piston 120 meets shoulder 121. Horizontal unit 13 is locked by the actuation of auxiliary piston 214 and vertical unit 17 is locked by the actuation of jacks 324. Die 26 is now ready for the casting operation and the die is registered over the die nozzle of the device by adjusting platform 12 on yoke 24. The step of adjusting platform 12 does not have to be repeated for each subsequent casting cycle, as explained in above mentioned U.S. Pat. No. 3,701,377. In the first step of the casting operation plunger 132 is moved into gate 25, by releasing pressure in port 126, to remove any sprue remaining from a previous casting cycle and the plunger is then withdrawn immediately to its previous position by re-applying pressure in port 126. In the next step die 26 is injected with pressurized molten metal and when the injection has been completed and the casting has solidified, ejection mechanism 18 is actuated to move plunger 132 downwardly again into gate 25 of die 26 by releasing the pressure in port 126. This ejects the sprue from die gate 25 and the plunger is then immediately withdrawn upwardly out of die cavity 34 releasing the pressure in port 122 and applying pressure in port 124 to raise piston 118 in chamber 116. To open die 26, (1) horizontal die closing unit 13 is unlocked by actuating auxiliary piston 114 and retracting piston 210, and (2) vertical die closing unit 17 is unlocked by actuating jacks 324 and raising piston 56. Upper die part 36 is raised with piston 56 to plate 38 adjacent legs 400. Jack 16 is then actuated to press ejector plate 38 against springs 40 which moves ejector pins 42 against the top of the casting and forces the casting out of upper die part 36.

It will be appreciated that the orientation of locking arms 306 of vertical die closing unit 17, being substantially in line with the force of the pressurized molten metal in die 26 acting through piston 56 and bearing plate 94, transfers that force to bolts 21 in frame 10. This construction enables the main parts of die 26 to be locked under high pressure.

I claim:

1. In pressure die casting apparatus, a sprue ejection mechanism comprising a cylinder having a closed chamber, a piston rod mounted coaxially through the chamber and projecting therefrom, a first annular piston fixed on the piston rod and reciprocally operable in the chamber, an axial bore in the piston rod, a plunger rod movable coaxially in the bore, adjustment means mounted on the plunger rod and on the piston rod adjacent one projecting end thereof for longitudinal adjustment of the plunger rod relative to the piston rod, the chamber having a first bore accommodating the first piston and a second bore coaxially with the first bore, the second bore being of larger diameter than the first bore and at the end of the first bore remote from the adjustment means, a second annular piston mounted on the piston rod and freely slidable in the second bore and on the piston rod, a first port opening into that end of the first bore remote from the second bore, a second port opening into the chamber at that end of the second bore adjacent the first bore, and a third port opening into that end of the second bore remote from the second port.

2. A device as claimed in claim 1 in which the adjustment means comprises a collar mounted on the piston, the plunger rod being in threaded engagement with the collar.

3. A device as claimed in claim 2 including locking means releasable to separate the collar from the piston.

4. A device as claimed in claim 3 in which the locking means comprises a key fixed externally on the collar and an apertured cap removably threaded onto one end of the piston rod.

5. A device as claimed in claim 4 including means mounted on the cylinder to releasably lock the cap against rotation on the piston rod.

6. A device as claimed in claim 4 including damping means mounted on the cylinder and means mounted on the piston rod to contact the damping means on movement of the first piston to a position adjacent the end of the chamber carrying the first port.

* * * * *